US008263220B2

(12) United States Patent
Hayashi et al.

(10) Patent No.: US 8,263,220 B2
(45) Date of Patent: Sep. 11, 2012

(54) WORK SUBJECT MATERIAL, SURFACE PROTECTION SHEET AND METHOD OF WORKING

(75) Inventors: Keiji Hayashi, Osaka (JP); Kazuhito Okumura, Osaka (JP); Yoshikazu Tanaka, Osaka (JP); Hideo Hara, Kanagawa (JP); Toru Inamasu, Kanagawa (JP)

(73) Assignee: Nitto Denko Corporation, Osaka (JP)

( * ) Notice: Subject to any disclaimer, the term of this patent is extended or adjusted under 35 U.S.C. 154(b) by 1473 days.

(21) Appl. No.: 11/572,522

(22) PCT Filed: Aug. 2, 2005

(86) PCT No.: PCT/JP2005/014090

§ 371 (c)(1),
(2), (4) Date: Jan. 23, 2007

(87) PCT Pub. No.: WO2006/013842

PCT Pub. Date: Feb. 9, 2006

(65) Prior Publication Data

US 2008/0254249 A1 Oct. 16, 2008

(30) Foreign Application Priority Data

Aug. 6, 2004 (JP) ..... 2004-231486
Jul. 8, 2005 (JP) ..... 2005-200763

(51) Int. Cl.
*B32B 7/12* (2006.01)

(52) U.S. Cl. ..... 428/343; 428/344; 428/355 R; 428/355 AC; 428/212; 428/215; 428/220; 428/216; 428/41.7

(58) Field of Classification Search ..... None
See application file for complete search history.

(56) References Cited

U.S. PATENT DOCUMENTS

| | | | | |
|---|---|---|---|---|
| 4,517,255 | A * | 5/1985 | Kanda et al. | 428/626 |
| 4,826,885 | A | 5/1989 | Tsai | |
| 5,601,917 | A * | 2/1997 | Matsui et al. | 428/356 |
| 2005/0220926 | A1 | 10/2005 | Naito et al. | |
| 2005/0247181 | A1 | 11/2005 | Kato | |
| 2009/0123740 | A1 * | 5/2009 | Hanaki et al. | 428/337 |

FOREIGN PATENT DOCUMENTS

| | | | |
|---|---|---|---|
| JP | 57-54068 | | 11/1962 |
| JP | 57-054068 | | 11/1962 |
| JP | 52-050475 | | 11/1977 |
| JP | 52-50475 | | 11/1977 |
| JP | 4-80609 | | 7/1992 |
| JP | 4-080609 | | 7/1992 |
| JP | 5-239418 | | 9/1993 |
| JP | 5-317988 | A | 12/1993 |
| JP | 7-026224 | A | 1/1995 |
| JP | 7-276588 | | 10/1995 |
| JP | 10-005874 | A | 1/1998 |
| JP | 2000-051966 | | 2/2000 |
| JP | 2000-51966 | | 2/2000 |
| JP | 2004-1055 | | 1/2004 |
| JP | 2004-001055 | | 1/2004 |
| JP | 2004-17113 | | 1/2004 |
| JP | 2004-017113 | | 1/2004 |

OTHER PUBLICATIONS

Tsunoda Kenji, "Ultra High Precision Adhering Method in Single Surface Lapping and Polishing of Wafer", abstract of JP 57-054068, Mar. 31, 1982.*
Istvan Benedek et al., "Pressure-Sensitive Adhesive Technology", Marcel Dekker, Inc., p. 329, 1997.*
English language Abstract of JP 5-239418.
English language Abstract of JP 55-5975.
English language Abstract of JP 2000-51966.
English language Abstract of JP 2004-1055.
English language Abstract of JP 2004-17113.
English language Abstract of JP 7-026224 A.
English language Abstract of JP 5-317988 A.
English language Abstract of JP 10-005874 A.
Japan Office action, mail date is Oct. 2010.

* cited by examiner

*Primary Examiner* — Alicia Chevalier
*Assistant Examiner* — Anish Desai
(74) *Attorney, Agent, or Firm* — Greenblum & Bernstein P.L.C.

(57) ABSTRACT

A work subject material comprising a metal plate for use in punching and/or bending and, attached thereto, a surface protection sheet, characterized in that the surface protection sheet comprises a support base material and an adhesive layer superimposed on one surface of the support base material and that the surface protection sheet exhibits a coefficient (I) not more than 21.0, a coefficient (II) not less than 4.0 and a coefficient (III) not more than 1.5, which are calculated by the following formulae: (I)=thickness of support base material (mm)×elongation at break of surface protection sheet (%); (II)=thickness of support base material (mm)×strength at break of surface protection sheet (N/20 mm); and (III)=coefficient (I)/coefficient (II).

6 Claims, 3 Drawing Sheets

WORK SUBJECT MATERIAL, SURFACE PROTECTION SHEET AND METHOD OF WORKING

TECHNICAL FIELD

The present invention relates to a work subject material having a surface protection sheet attached thereto to protect a metal surface in punching and/or bending a metal plate or the like, the surface protection sheet and a working method of punching and/or bending the work subject material.

BACKGROUND ART

In prior arts, Japanese Patent Examined Application Publication No. 57-54068 etc. proposes a surface protection sheet for protecting a surface of a metal plate. The surface protection sheet is applied to prevent the metal surface from being damaged by scratches in processing, transporting or stacking the metal plate.

These surface protection sheets are used when bending metal plates mainly, intending to prevent an occurrence of scratches on the metal plates due to contacts between a bending die and the metal plates at processing. Further, when a punch press is used in a process preceding the bending process, there is a possibility that a punching chip remaining in a lower metal mold (die) after completing the punching process rises with an elevation of an upper metal mold (punch) for the punch press, runs on a surface of the metal plate or enters between the work subject material and the die. In this case, the surface (upper or lower surface) of the metal plate is damaged (scratches etc.) since the upper metal mold bears down the punching chip at a sequent punching process (note, this phenomenon will be referred to as "chip-up phenomenon" hereinafter).

In case of punching a metal plate equipped with this surface protection sheet, the chip-up phenomenon becomes remarkable because there is a possibility that the surface protection sheet is not cut off to cause a punching chip or the protection sheet itself to run on the surface of the metal plate. In order to solve the above chip-up phenomenon, there are proposed dies intending to prevent an occurrence of the chip-up phenomenon, in Japanese Utility Model Examined application Publication No. 52-50475, Japanese Patent Application Laid-open No. 2000-51966, Japanese Patent Application Laid-open No. 2004-1055 and Japanese Patent Application Laid-open No. 2004-17113. With the use of the dies proposed in these publications, it is possible to suppress the occurrence of chip-up phenomenon. Depending on the variety of surface protection sheets, however, there also exists a die that is almost ineffective in reducing the chip-up phenomenon.

In order to prevent an occurrence of scratches on the surfaces of metal plates in stacking or transporting them after punching, additionally, there is also devised a countermeasure where it is not performed at punching to apply the surface protection sheet accounting for the chip-up phenomenon onto the surface of the metal plate, but instead performed at stacking a punched metal plate to firstly apply a surface protection sheet on a previously-punched metal plate and secondly stack the presently-punched metal plate on the surface protection sheet. However, this countermeasure is accompanied with considerably-troublesome task because this attaching operation of the surface protection sheet is normally performed by worker's hands manually.

DISCLOSURE OF THE INVENTION

As a result of investigating countermeasures to solve the above-mentioned problem with our whole hearts, inventors found that although the chip-up phenomenon at punching could be suppressed by an alteration to a die proposed in the above publications, the same die has almost no effect in the where that the thickness of a surface protection sheet of polyolefine or plasticized polyvinyl chloride, which is well-known in the art, is increased. As one means for suppressing the chip-up phenomenon, there is a countermeasure to reduce the thickness of a surface protection sheet. However, since the metal plate after being punched out is subsequently subjected to a bending process using a press brake in the greater number of cases, the adoption of such a thin surface protection sheet causes a base material to be torn at bending and also causes the surface of a metal plate to be damaged by bending scratches at bending, producing defective products as one unsatisfactory result. Therefore, an object of the present invention is to propose a superior surface protection sheet that produces neither the chip-up phenomenon at punching nor the broken base material and the bending scratches at bending, and a working method using the surface protection sheet.

As a result of investigating countermeasures to solve the problem, the inventors have found out the following work subject material having a surface protection sheet attached thereto for use in punching and bending processes and a working method for the work subject material and furthermore, the inventors have completed the present invention.

According to the present invention, there is provided a work subject material comprising a metal plate for use in punching and/or bending and a surface protection sheet attached to the metal plate, characterized in that the surface protection sheet comprises a support base material and an adhesive layer superimposed on one surface of the support base material and that the surface protection sheet exhibits a coefficient (I) not more than 21.0 and a coefficient (II) not less than 4.0, both of which are calculated by the following formulae.

(I)=thickness of support base material (mm)×elongation at break of surface protection sheet (%)

(II)=thickness of support base material (mm)×strength at break of surface protection sheet (N/20 mm)

According to the present invention, the surface protection sheet can suppress the chip-up phenomenon since the above coefficient (I) has a value not more than 21.0 and the above coefficient (II) has a value not less than 4.0. Additionally, owing to the provision of the surface protection sheet, it is possible to suppress an occurrence of the broken base material and the bending scratches in a bending process.

BEST MODE FOR CARRYING OUT THE INVENTION

Figure 1:
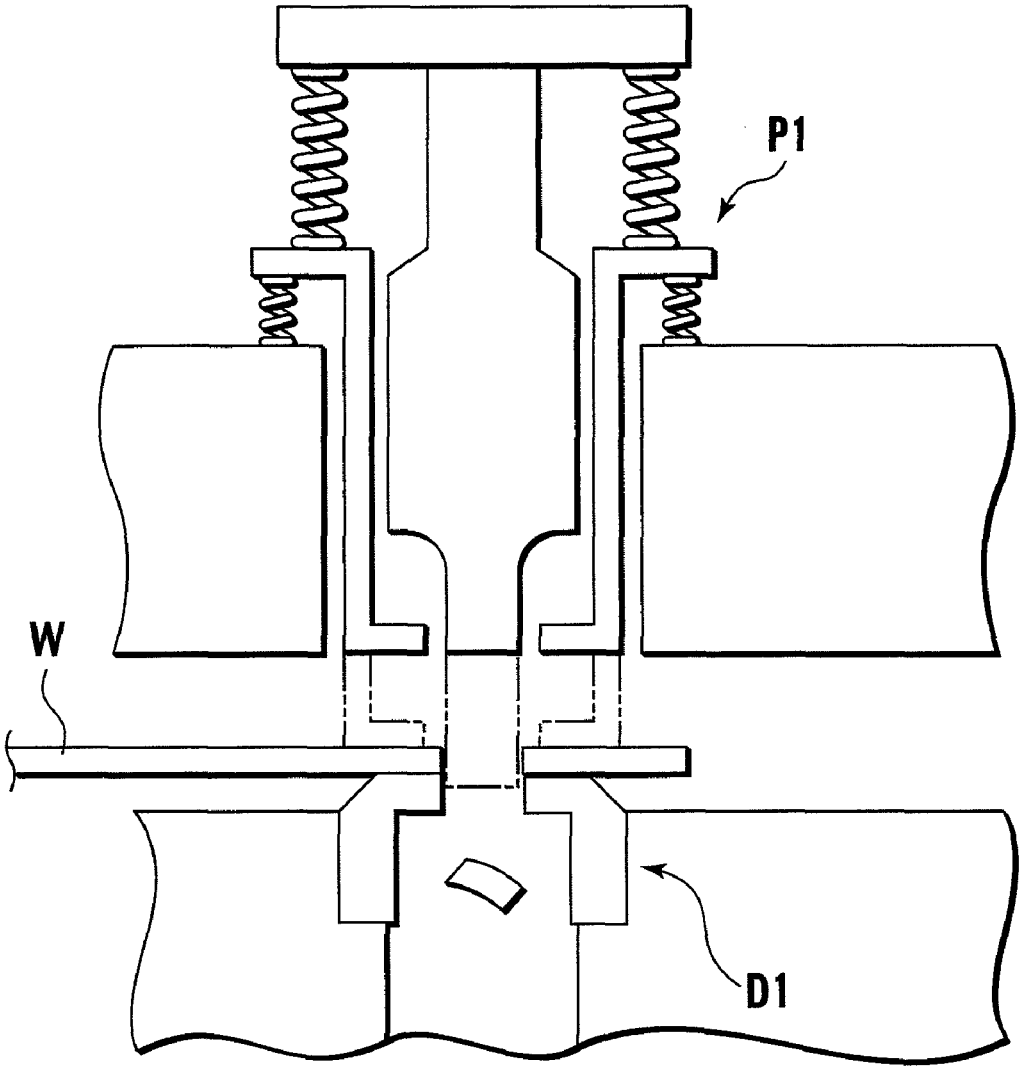
FIG. 1 is a schematic view explaining a constitution of a punching die performing a punching process.

The chip-up phenomenon that is caused when punching a work subject material W having a surface protection sheet attached thereto with the use of a general punching die having a punch (male die) P1 and a die (female die) D1 as shown in FIG. 1, comes from the following reasons mainly.

(1) Either a punching chip produced in a punching process and having a place in a lower metal mold (die) or a surface protection sheet punched out simultaneously, or both of the punching chip and the surface protection sheet are lifted up with a rise of an upper metal mold (punch), so that the punching chip and the surface protection sheet run on a surface of a metal plate. When the upper metal mold presses the punching chip and the surface protection sheet at a subsequent punching process, flaws are produced on the surface of the metal plate.

(2) If the afore-mentioned coefficient (I) gets larger, there is caused a state where the surface protection sheet is not cut off perfectly. As a result, since either the surface protection sheet or both of the incompletely-cutout surface protection sheet and the punching chip run on a top surface of the work subject material or since either the punching chip or the surface protection sheet is pinched between the work subject material and the die, flaws more than those in the above case (1) are produced.

(3) Additionally, there is a case of performing punching processes successively while overlapping a part of previously-punched material portion on a material portion to be punched subsequently (which will be referred to as "over-take processing"). In this over-take processing, if using a work subject material having a surface protection sheet attached thereto and having a large value in the above coefficient (I), then there noticeably arises a situation that in particular, the surface protection sheet cannot be cut off perfectly, causing the chip-up phenomenon frequently.

Figure 2:
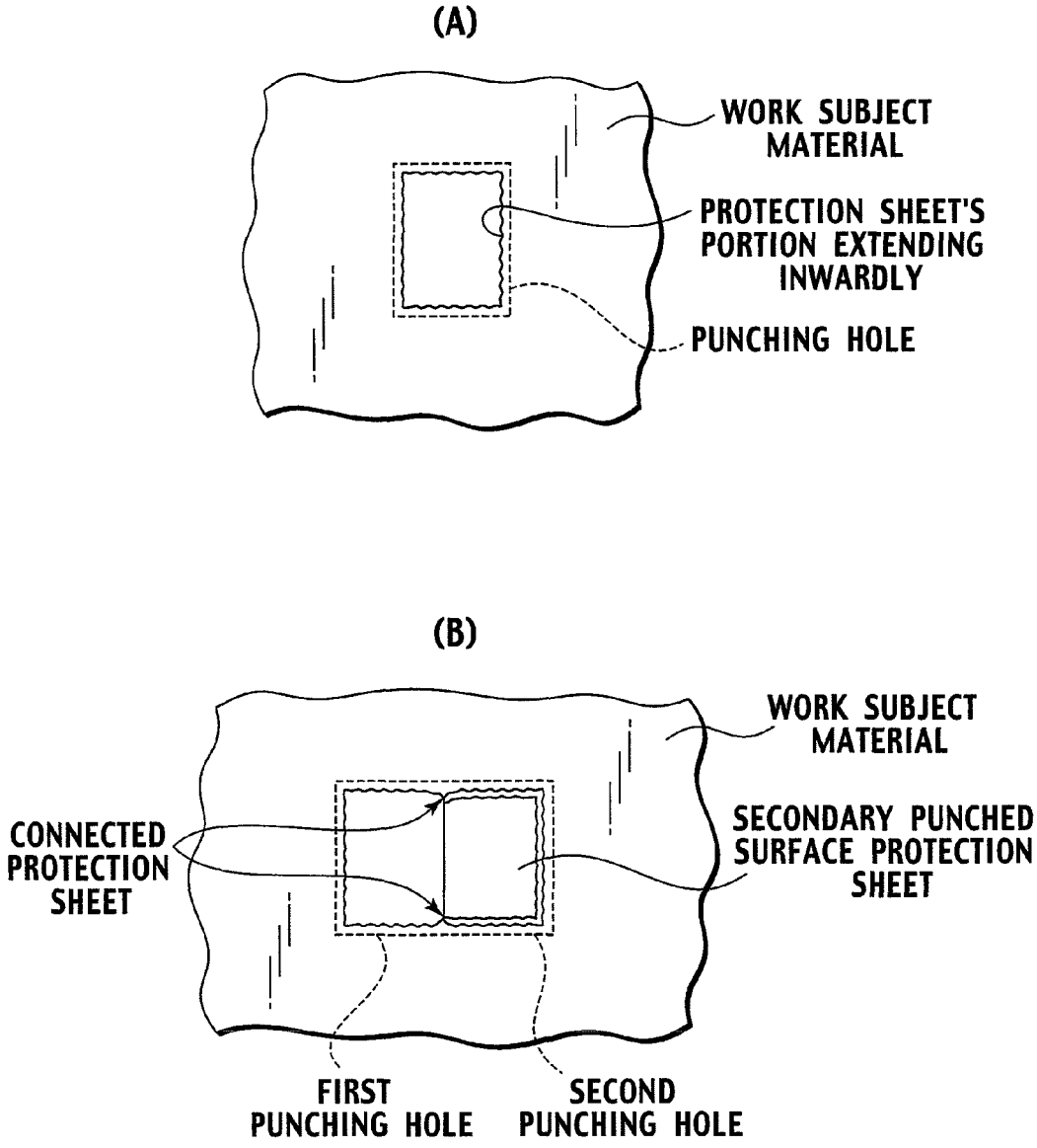
FIG. 2 is a view explaining a cause of chip lifting in the punching process by the punching die.

We now explain the above phenomenon. On condition that a first punching process has been applied on the work subject material having the surface protection sheet attached thereto and having a large value in the above coefficient (I), the surface protection sheet extends inwardly in a punched hole formed in the punched work subject material (see FIG. 2). This comes from a situation where the protection sheet is cut off while being dragged into the hole of the work subject material during the punching process. Subsequently, in case of successively punching the material upon moving it so as to overlay the first punching hole partially, the surface protection sheet's portion extending inwardly of the punching hole is connected with the surface protection sheet cut off at the second punching process.

Further, due to an adhesive applied on the so-connected surface protection sheet, a punching chip remains to be stuck on the so-connected surface protection sheet. If performing a sequent punching process under this situation, then either the surface protection sheet or the punching chip stuck on the surface protection sheet intervenes between the work subject material and the die, so that it becomes easy to cause the chip-up phenomenon, particularly, at this over-take processing.

It is proved that, as for the above item (1), it is possible to suppress the lift-up of chips in certain degree by providing a chip lift-proof die. While, as for the item (2), the reduction effect by using the chip lift-proof die is small since it is attributable to defective cutting of the surface protection sheet. It is proved that, as for the item (3), the using of a chip lift-proof die provides no particular effect. Therefore, it is found that it is necessary to minimize the extended portion of the surface protection sheet in order to suppress the phenomenon like the items (2) and (3).

It is proved in view of shortening the extended portion of the surface protection sheet that these problems can be solved by making the above coefficient (I) of the surface protection sheet smaller. That is, we have investigated that the above phenomenon could be suppressed by reducing the thickness of the surface protection sheet in view of reducing the coefficient (I) or, in case of a surface protection sheet having a large thickness, by reducing its elongation at fracture.

Figure 3:
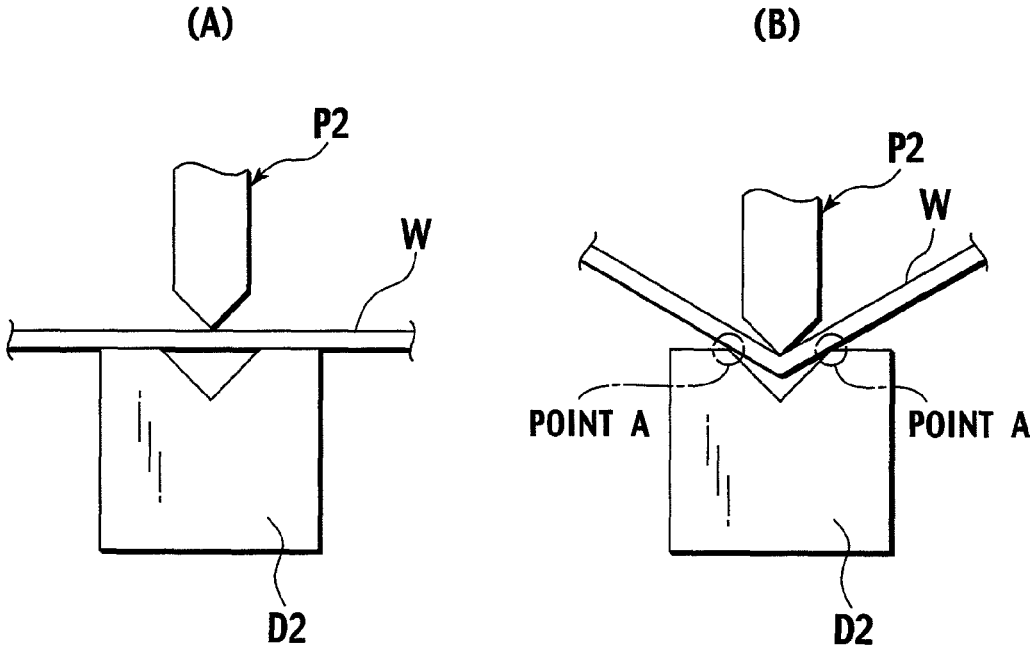
FIG. 3 is a schematic view explaining a constitution of a bending die performing a bending process.

According to the bending work using a general bending die consisting of the punch (male die, upper metal mold) P2 and the die (female die, lower metal mold) D2, as shown in FIG. 3, the work subject material W is mounted on the lower metal mold (die) D2 firstly. Then, the upper metal mold (punch) P2 applies pressure on the work subject material W at a predetermined bending point, so that the work subject material is bent. During this bending operation of the work subject material under pressure, the work subject material comes into contact with the die as if the same material is sliding on the die from a die's shoulder part (point A) to a die's bending groove, producing bending (sliding) scratches that are continuous in the longitudinal direction of the work subject material. Therefore, it has been attempted in the bending work to attach a surface protection sheet to the work subject material. However, since the bending work is presently carried out under various pressures corresponding to the working conditions, for example, quality of the work subject material, plate thickness, flexural strength, sorts of bending, etc., there arises a problem that the surface protection sheet is torn due to an excessive bending pressure or that bending scratches are produced on a metal plate.

Thus, it is found that a surface protection sheet proof against pressure at the bending work is required to suppress an occurrence of bending scratches at the bending work and that the problem can be solved by increasing the above coefficient (II) of the surface protection sheet. Namely, in view of increasing the coefficient (II), we have investigated that the occurrence of bending scratches could be suppressed by either increasing the thickness of the surface protection sheet or enhancing a breaking strength of the surface protection sheet even when its thickness is small.

Accordingly, the surface protection sheet usable in the present invention has to be one that can satisfy coefficients obtained by the following formulae.

(I)=thickness of support base material (mm)×elongation at break of surface protection sheet (%)

(II)=thickness of support base material (mm)×strength at break of surface protection sheet (N/20 mm)

In the present invention, "elongation at break" and "strength at break" of surface protection sheet are defined as values measured by a later-mentioned method.

The support base material used in the surface protection sheet for use in punching and bending work has to be one that can satisfy both conditions of the above coefficient (I) not more than 21.0 and the coefficient (II) not less than 4.0. Although the surface protection sheet is required to have a large thickness and a high strength at break in view of producing no bending scratches, such a thickened surface protection sheet may produce the chip lift-up phenomenon at a punching process preceding a bending process. Therefore, for a work subject material that will be bended subsequently to the punching process, if the work subject material has both of the coefficients (I) and (II), then it becomes possible to prevent an occurrence of both metal-plate scratch at punching due to the chip lift-up phenomenon and bending scratch at bending.

Note that the punching of a metal plate having a surface protection sheet attached thereto exhibits high possibility of lifting up chips in comparison with the punching of a metal plate without a surface protection sheet. When possible, it is desirable that a metal plate is equipped with no surface protection sheet. Taking a quality of products (e.g. prevention of dent by a contact between a punch (stripper) and a metal surface at punching, prevention of scratches on the metal plate at subsequent bending, etc.) into consideration, however, a surface protection sheet becomes indispensable and more preferably, the surface protection sheet is formed thinly as possible. Particularly, if making the surface protection sheet thicker at bending, the thickness of the whole work subject material gets larger, requiring a correction for a falling position of the bending punch in order to attain a desired bending angle. From this point of view, therefore, it is desirable to adopt a thinner surface protection sheet.

The support base material used in the present invention is a polymer film made of macromolecules. For example, the support base material is provided with the use of one or more than two kinds of: propylene polymer (e.g. homo-type, block-type, random-type etc.); ethylene polymer (low-density, high-density, linear low-density, etc.); polyethylene terephthalate; polybutylene terephthalate; polyethylene naphthalate; polybutylene naphthalate; esters polymer composed of polylactic acid etc.; polyamid composed of 6-nylon, 6.6-nylon, 12-nylon and so on. As the support base material meeting the above coefficient (I), particularly, the same material is preferably obtained by a stretching process. Besides this, any support base material will do so long as it meets the above coefficient (I), for example, addition of filler, crosslinking by electron beam etc., multilayer extrusion of the base material, multilayered coating and so on. As the support base material used suitably, a biaxially stretched polyester film is desirable in views of preventing an occurrence of chip-up phenomenon and bending workability.

Besides the filler (e.g. calcium carbonate, talc, calcium oxide, etc.), an appropriate additive (e.g. anti-blocking agent, lubricant, titan oxide, organic/inorganic pigment for color pigment, antioxidant for preventing degradation, ultraviolet absorption agent, light stabilizer, antistatic additive, etc.) may be blended into the support base material. Additionally, with the aim of improving the adhesiveness with back-treating agent, adhesive and primer, an appropriate surface treatment, such as corona treatment, may be applied on a surface of the support base material. Generally, the thickness of the support base material is within the range of 0.020~0.200 mm, most of all, 0.025~0.125 mm. However, the invention is not limited to this only.

As the adhesive used for the surface protection sheet, there are available rubber adhesive, acrylic adhesive, polyester adhesive and polyurethane adhesive all well known in the art.

In these adhesives, rubber adhesive and acrylic adhesive are desirable from the viewpoint of adhesiveness to the metal plate, exfoliative property therefrom and cost.

As the rubber adhesive, there are presented natural-rubber adhesive, synthetic-rubber adhesive and so on. As major components for the synthetic-rubber adhesive, there are available, polybutadiene, polyisoprene, butyl-rubber, polyisobutylene, styrene elastomer (e.g. styrene/butadiene/styrene block copolymer), styrene elastomer (e.g. styrene/ethylene-butylene/styrene block copolymer, styrene/ethylene-butylene/random copolymer), ethylene propylene rubber, etc.

As the acrylic adhesive, there is available a copolymer of monomer mixture that contains, as a main component, alkyl (meta)acrylate [e.g. butyl(meta)acrylate, 2-ethylhexyl(meta)acrylate] and if necessary, reforming monomer capable of copolymerizing the main component, for example, hydroxyl-containing monomer [e.g. 2-hydroxyethyl(meta)acrylate], carboxyl-containing monomer [e.g. (meta)acrylic acids], styrene monomer (e.g. styrene) and, vinylester (e.g. vinyl acetate). The acrylic adhesive can be produced by a conventional polymerizing method, for example, solution polymerizing method, emulsion polymerizing method, UV polymerizing method and so on.

As occasion demands with a view to control the adhesive properties of these adhesives, they may be admixed with appropriate additives, for example, crosslinking agent, tackifier, softener, olefin resin, silicone polymer, liquid acrylic copolymer, phosphate ester compound, antioxidant, light stabilizer such as hindered amic light stabilizer, ultraviolet absorbent, other fillers and pigments (e.g. calcium oxide, magnesium oxide, calcium carbonate, silica, zinc oxide, titan oxide), etc.

The blending of tackifier is effective in the improvement of adhesive force. Considering the improvement of adhesive force while avoiding an occurrence of adhesive deposit due to a deterioration of cohesive force, it is desirable that the tackifier is blended within the blending-amount range of 0~50 weight-ratio for the adhesive 100 weight-ratio, most of all, 0~30 weight-ratio for the adhesive 100 weight-ratio, and particularly, 0~10 weight-ratio for the adhesive 100 weight-ratio.

As the tackifier, there is available one or more than two kinds of the following appropriate adhesives well known in the art: aliphatic series resins, aromatic series resins, petroleum resins (e.g. aliphatic/aromatic copolymer series resin and alicyclic series resin), coumarone-indene resin, terpene resin, terpene-phenol resin, polymer rosin resin, (alkyl)phenol resin and xylene resin or their hydrogenerated resin.

The blending of softener is effective in the improvement of adhesive force. As the softener, there is available one or more than two kinds of, for example, diene-series polymer of low molecular weight, polyisobutylene, hydrogenerated polyisoprene, hydrogenerated polybutadiene and their derivatives. Although the amount of blending may be established as a user thinks proper, it is desirable that the softener is blended within the blending-amount range of 0~40 weight-ratio for the adhesive 100 weight-ratio, most of all, range of 0~20 weight-ratio for the adhesive 100 weight-ratio, and particularly, 0~10 weight-ratio for the adhesive 100 weight-ratio. If the amount of blending exceeds 40 weight-ratio, then the adhesive deposit at high temperature or outdoor exposure becomes remarkable.

The thickness of an adhesive layer to be formed may be determined in accordance with the adhesive force. Generally, the thickness is established to be a value in the range of 0.001~0.050 mm, most of all, 0.002~0.020 mm and particularly, the range of 0.003~0.010 mm. If desired, the adhesive layer may be temporarily protected by a release liner until it is provided for practical use.

The formation of the surface protection sheet may be accomplished in accordance with an adhesive-sheet forming method well known in the art, for example, method of applying a solution of adhesive composition by solvent or hot-melt liquid on a base material substrate, method of transferring an adhesive layer applied on the release liner to a support base material, method of applying an adhesive-layer forming material on a support base material by extrusion, method of extruding a base material and an adhesive layer by two-layer or multilayer, method of laminating a single adhesive layer on a base material or laminating it thereon together with a laminate layer by two-layer and method of laminating an adhesive layer and a support base material forming material (e.g. film and laminate layer) by two-layer or multilayer.

Generally, a release agent for the mold-releasing layer is composed of solvent or non-solvent silicone polymer, long-chain alkyl polymer or the like.

Specifically, there are available "pyroyle" (made by Ipposha Oil Industries Co., Ltd.), "Shin-Etsu silicon" (made by Shin-Etsu Chemical Co., Ltd.) and so on. As for a method of forming the mold-releasing layer, it may be accomplished in accordance with a well-known coating method, for example, coating method using a roll coater, such as gravure roll, spraying method using a spray and so on.

EXAMPLES

Example 1

We first made an acrylic pressure sensitive adhesive solution by adding an isocyanate crosslinking agent (made by Nippon Polyurethane Industry Co., "coronate L") 3 weight-ratio to acrylic pressure sensitive adhesive (polystyrene-equivalent mean molecular weight: 600000, acetic ether solution) 100 weight-ratio having a compounding ratio of 2-ethylhexyl acrylate (2EHA) 30 wt %, ethyl acrylate (EA) 60 wt %, methyl meta acrylate (MMA) 6 wt % and 2-hydroxyethyl acrylate (HEA) 4 wt %. Next, by applying the above adhesive to a support base material of a biaxially stretched polyester film of 0.100 mm in thickness (made by Toray Industries, Inc. "lumirror S-10") and subsequently drying the so-applied support base material so as to attain 0.010 mm in thickness of the dried adhesive, we made a surface protection sheet.

Example 2

We made a surface protection sheet according to Example 1 but applying the adhesive of Example 1 to a support base material of a biaxially stretched polyester film of 0.038 mm in thickness (made by Toray Industries, Inc. "lumirror S-10") and subsequently drying the so-applied support base material.

Example 3

We made a surface protection sheet according to Example 1 but applying the adhesive of Example 1 to a support base material of a biaxially stretched polyester film of 0.075 mm in thickness (made by Mitsubishi Plastics, Inc. "ecoroju") and subsequently drying the so-applied support base material.

Example 4

We first made a rubber pressure sensitive adhesive (toluene solution) by adding a hydrogenerated petroleum resin (made by Arakawa Chemical Industries, Ltd., "archon P-100") 30 weight-ratio to styrene/etylene-butylene/styrene block copolymer (made by Asahi Kasei Corp. "tuftec H1062") 100 weight-ratio. Next, by applying the above adhesive to a support base material of a biaxially stretched polyester film of 0.060 mm in thickness and subsequently drying the so-applied support base material so as to attain 0.005 mm in thickness of the dried adhesive, we made a surface protection sheet.

Example 5

We made a surface protection sheet according to Example 1 but applying the adhesive of Example 1 to a support base material of a biaxially stretched polyester film of 0.050 mm in thickness (made by Toray Industries, Inc. "lumirror S-10") and subsequently drying the so-applied support base material.

Example 6

We made a surface protection sheet according to Example 1 but applying the adhesive of Example 1 to a support base material of a biaxially stretched polyester film of 0.038 mm in thickness (made by Toray Industries, Inc. "lumirror X-20") and subsequently drying the so-applied support base material.

Comparative Example 1

By forming a low-density polyethylene film (made by Tosoh Corp. "petrothene 180") by inflation method at 160° C. in die temperature, we made a support base material having the thickness of 0.110 mm. Next, we applies a corona discharging treatment on a support base material's surface for adhesive and subsequently applies the adhesive of Example 1 on the support base material's surface so as to attain 0.010 mm in thickness of the dried adhesive.

Comparative Example 2

By forming a low-density polyethylene film (made by Tosoh Corp. "petrothene 180") by inflation method at 160° C. in die temperature, we made a support base material having the thickness of 0.060 mm. Next, we applies a corona discharging treatment on a support base material's surface for adhesive and subsequently applies the adhesive of Example 1 on the support base material's surface so as to attain 0.010 mm in thickness of the dried adhesive.

Comparative Example 3

By rolling a compounded material of polyvinylchloride resin (mean polymerization degree: 1100) of 100 weight-ratio, dioctyl phthalate of 35 weight-ratio and Ba-Zn type composite stabilization agent of 2 weight-ratio by a colander method, we got a soft polyvinyl chloride film having the thickness of 0.120 mm. Next, we applied the adhesive of Example 1 on the film so as to attain 0.015 mm in thickness of the dried adhesive.

Comparative Example 4

By forming a polypropylene film (made by Sumitomo Chemical Co., "nobrene PP AS171G") by T-die method at 250° C. in die temperature, we made a support base material having the thickness of 0.040 mm. Next, we applied the adhesive of Example 4 on the support base material in accordance with Example 4 but attaining 0.010 mm in thickness of the dried adhesive.

Comparative Example 5

We made a support base material with no surface protection sheet.

<Tensile Test (strength at break, elongation at break)>

The tensile test was performed in accordance with JIS K7127(1999). Using measuring specimen in accordance with Specimen type 2 described in JIS K7127 with respect to MD direction, the tensile test was performed under conditions of 50 mm in chuck interval, 10 mm in specimen width and 300 mm/min in testing speed. Additionally, an instron type tensile testing machine (made by Shimadzu Corp. Autograph) was used for measurement. The strength at break and the elongation at break can be calculated by both strength and elongation percentage at break of the surface protection sheet.

[Punching Test in Punch Press]

In the punching test, a punching operation for a work subject material was performed with the use of the above-constructed punching die. Note that the punching operation was performed on contacting a punch with the surface protection sheet. Note that the punching conditions are as follows: metal plate thickness of the work subject material: 1.0 mm; metal plate material: SUS430-2B, AL5052 and SPCC; punching dimensions: 5.0 mm×5.0 mm; die clearance: 0.2 mm; punching recipe: punching of 4-openings (each 9.0 mm×9.0 mm); punch's thrusting amount into die: 1.0 mm; and total number of punches: 1000 punches. Under the conditions, we counted up the number of chip-up phenomenon in each of the examples 1 to 6 and the comparative examples 1 to 5. Regarding the number of chip-up phenomenon, it is difficult to count up the number of chips lifted up in the chip-up phenomenon. For this reason, instead, we adopt a method of counting up the number of scratches on respective surfaces of the work subject materials as a result of the chip-up phenomenon.

(Example 1) Support Base Material: biaxially stretched polyester film, thickness: 0.100 mm, elongation: 205%, strength at break: 360 N/20 mm (Example 2) Support Base Material: biaxially stretched polyester film, thickness: 0.038 mm, elongation: 180%, strength at break: 150 N/20 mm (Example 3) Support Base Material: biaxially stretched polyester film, thickness: 0.075 mm, elongation: 203%, strength at break: 272 N/20 mm (Example 4) Support Base Material: biaxially stretched polypropylene film, thickness: 0.060 mm, elongation: 215%, strength at break: 370 N/20 mm (Example 5) Support Base Material: biaxially stretched polyester film, thickness: 0.050 mm, elongation: 232%, strength at break: 217 N/20 mm (Example 6) Support Base Material: biaxially stretched polyester film, thickness: 0.038 mm, elongation: 140%, strength at break: 136 N/20 mm (Comparative Example 1) Support Base Material: low-density polyethylene film, thickness: 0.110 mm, elongation: 310%, strength at break: 45 N/20 mm (Comparative Example 2) Support Base Material: low-density polyethylene film, thickness: 0.060 mm, elongation: 302%, strength at break: 28 N/20 mm (Comparative Example 3) Support Base Material: soft polyvinyl chloride film, thickness: 0.120 mm, elongation: 280%, strength at break: 75 N/20 mm (Comparative Example 4) Support Base Material: polypropylene film, thickness: 0.040 mm, elongation: 680%, strength at break: 45 N/20 mm (Comparative Example 5) No surface protection sheet

[Bending Test by Press Brake]

The bending test was performed with the use of a bending die as mentioned before. At bending, the surface protection sheet was brought into contact with the die. Then, work subject materials (metal-plate material: SUS430-2B, AL5052 and SPCC, metal plate thickness: 1.0 mm and 1.5 mm) were used. The bending tests of 90 degrees at two positions were performed with respect to each work subject material by five pieces each. After performing the bending tests while changing the bending conditions, we did confirm bending scratches, breakage of film breakage and film peeling about the tested materials. The bending conditions are as follows.

(1) Bend Angle: 90°, Punching Angle: 88°, Punching Nose R: 0.2 mm, Die-V Width: 10 mm, Die Angle: 88°, Die Shoulder R: 0.5 mm, Plate Thickness: 1.0 mm, Plate Material: SUS430

(2) Bend Angle: 90°, Punching Angle: 88°, Punching Nose R: 0.2 mm, Die-V Width: 8 mm, Die Angle: 88°, Die Shoulder R: 0.5 mm, Plate Thickness: 1.0 mm, Plate Material: SUS430

(3) Bend Angle: 90°, Punching Angle: 88°, Punching Nose R: 0.2 mm, Die-V Width: 12 mm, Die Angle: 88°, Die Shoulder R: 0.8 mm, Plate Thickness: 1.5 mm, Plate Material: SUS430

(4) Bend Angle: 90°, Punching Angle: 88°, Punching Nose R: 0.2 mm, Die-V Width: 12 mm, Die Angle: 88°, Die Shoulder R: 0.8 mm, Plate Thickness: 2.0 mm, Plate Material: AL5052

(5) Bend Angle: 90°, Punching Angle: 88°, Punching Nose R: 0.2 mm, Die-V Width: 16 mm, Die Angle: 88°, Die Shoulder R: 0.8 mm, Plate Thickness: 2.5 mm, Plate Material: AL5052

(6) Bend Angle: 90°, Punching Angle: 88°, Punching Nose R: 0.2 mm, Die-V Width: 18 mm, Die Angle: 88°, Die Shoulder R: 0.8 mm, Plate Thickness: 3.0 mm, Plate Material: AL5052

(7) Bend Angle: 90°, Punching Angle: 88°, Punching Nose R: 0.2 mm, Die-V Width: 6 mm, Die Angle: 88°, Die Shoulder R: 0.5 mm, Plate Thickness: 1.0 mm, Plate Material: SPCC (8) Bend Angle: 90°, Punching Angle: 88°, Punching Nose R: 0.2 mm, Die-V Width: 14 mm, Die Angle: 88°, Die Shoulder R: 0.8 mm, Plate Thickness: 1.6 mm, Plate Material: SPCC (9) Bend Angle: 90°, Punching Angle: 88°, Punching Nose R: 0.2 mm, Die-V Width: 12 mm, Die Angle: 88°, Die Shoulder R: 0.8 mm, Plate Thickness: 1.6 mm, Plate Material: SPCC As shown in Table 1, sufficient effects have been confirmed in punching and bending of Examples 1 to 6.

TABLE 1

| | Base material thickness (mm) | Strength at break (N/20 mm) | Elongation at break (%) | Coefficient (I) | Coefficient (II) | Coefficient (III) | Punching | Bending | Overall judgment |
|---|---|---|---|---|---|---|---|---|---|
| Exam. 1 | 0.100 | 360 | 205 | 20.5 | 36.0 | 0.57 | ○ | ○ | ○ |
| Exam. 2 | 0.038 | 150 | 180 | 6.9 | 5.7 | 1.21 | ○ | ○ | ○ |
| Exam. 3 | 0.075 | 272 | 203 | 15.2 | 20.4 | 0.75 | ○ | ○ | ○ |
| Exam. 4 | 0.060 | 370 | 215 | 12.9 | 22.2 | 0.58 | ○ | ○ | ○ |
| Exam. 5 | 0.050 | 217 | 232 | 11.6 | 10.9 | 1.06 | ○ | ○ | ○ |
| Exam. 6 | 0.038 | 136 | 140 | 5.3 | 5.2 | 1.02 | ○ | ○ | ○ |
| Comp. Exam. 1 | 0.110 | 45 | 310 | 34.1 | 5.0 | 6.82 | X | ○ | X |
| Comp. Exam. 2 | 0.060 | 28 | 302 | 18.1 | 1.7 | 10.65 | ○ | X | X |
| Comp. Exam. 3 | 0.120 | 75 | 280 | 33.6 | 9.0 | 3.73 | X | ○ | X |

TABLE 1-continued

| | Base material thickness (mm) | Strength at break (N/20 mm) | Elongation at break (%) | Coefficient (I) | Coefficient (II) | Coefficient (III) | Punching | Bending | Overall judgment |
|---|---|---|---|---|---|---|---|---|---|
| Comp. Exam. 4 | 0.040 | 45 | 680 | 27.2 | 1.8 | 15.11 | X | X | X |
| Comp. Exam. 5 | — | — | — | — | — | — | ○ | X | X |

As an estimation for the test results, we counted up scratches on the surface of a work subject material in punching and judged that the work subject material was good (○) if the number of scratches was within an allowance for products and that the work subject material was defective (×) if the number of scratches was out of the allowance for products. As will be understood from Table 1, work subject materials each having a coefficient (I) not less than 27.2 are judged as defective ones, while work subject materials each having a coefficient (I) not more than 20.5 are judged as good ones. Accordingly, in the range shown in Table 1, it is desired that the coefficient (I) is not more than 21.0 (20.5). Note that the work subject material is good in case of the coefficient (I) of 5.3 as the test results.

Here, it is noted that to make the coefficient (I) smaller while keeping the thickness of a support base material constant is synonymous with a fact that an elongation of the surface protection sheet at break gets smaller and is desirable in view of preventing an occurrence of scratches due to the chip-up phenomenon at punching. Therefore, in case of no elongation 0(%) of the surface protection sheet at break, the above coefficient (I) becomes "0". Thus, it is desirable that the coefficient (I) is within the range of 0~21.0.

As an estimation for the bending process, we observed the presence of scratches on testing pieces after the bending process and both break and peel of the films of the testing pieces and judged that a test piece was good (○) if it had not all of bending scratches, film's break and peel and that the test piece was defective (×) if it had any one of the bending scratches, the film's break and the film's peel.

Regarding the bending process, as will be understood from Table 1, work subject materials each having a coefficient (II) not more than 1.8 are judged as defective ones, while work subject materials each having a coefficient (II) not less than 4.0 (5.2) are judged as good ones. Accordingly, it is desired that the coefficient (II) is not less than 4.0.

Meanwhile, it should be noted that to make the coefficient (II) larger while keeping the thickness of a support base material constant is synonymous with a fact that a strength of the surface protection sheet at break gets larger. Thus, from the point of view of the bending process, it is desirable that the surface protection sheet's strength at break gets larger. Since there is no correlation between the punching process and the strength at break, the punching property would not be influenced even if making the strength at break larger. Nevertheless, it is noted that to make the strength at break larger is conductive to an increase in the thickness of a surface protection sheet. If the surface protection sheet is thickened, an engagement accuracy between the upper metal mold and the lower metal mold at the bending process is influenced to exert an influence on its bending accuracy.

Therefore, it is desirable that an upper limit of the above coefficient (II) is 60 from the point of view of exerting no influence on the bending accuracy. Namely, it is preferable that the coefficient (II) is within the range of 4.0~60.0.

And now, there is a hemming bending in the field of bending. In this hemming bending, an acute-angled bending at an acute angle not more than 90 degrees is applied on a metal plate at a first step and subsequently, a collapse bending of approximating an angle of the acute-angled metal plate to 0 degrees is performed at a second step.

The bending operation requiring such an acute-angled bending step demands a bending pressure higher than that at bending at 90 degrees in the above bending tests. As a result of performing the acute-angled bending tests (bending angle: 35°, punching angle: 30°, die angle: 30°) against the examples 1 to 6 under the same condition as the above bending tests, we confirmed that a film in the example 6 was torn in spite of non-defectiveness in terms of bending scratches and film's peel. Therefore, it is desirable that the coefficient (II) of a surface protection sheet is not less than 5.3 in the bending operation requiring the acute-angled bending step.

Accordingly, for the work subject material, the coefficient (I) not more than 21.0 and the coefficient (II) not less than 4.0 are desirable. More desirably, the coefficient (I) is within the range of 3.0~21.0 and the coefficient (II) is within the range of 4.0~60.0. Further, according to the testing range, it is desirable that the coefficient (I) is within the range of 5.0 (5.3) ~21.0 (20.5), while the coefficient (II) is within the range of 5.0 (5.2)~36.0. As for the bending operation requiring the acute-angled bending step, it is desirable that the coefficient (II) is within the range of 5.4~36.0.

For superior bending and punching properties, it is desirable that the coefficient (III) obtained by the following formula is not more than 1.5. More preferably, the coefficient (III) is within the range of 0.4~1.4. Additionally, according to the test values, it is desirable that the coefficient (III) is within the range of 0.5 (0.57)~1.3 (1.21).

$$(\text{III}) = \text{coefficient (I)}/\text{coefficient (II)}$$

Industrial Applicability

The present invention provides a work subject material having a surface protection sheet attached thereto for protecting a metal surface in punching and/or bending a metal plate or the like, the surface protection sheet and a punching and/or bending method using the work subject material. According to the present invention, it is possible to provided a superior surface protection sheet and a working method, both of which produce no chip-up phenomenon in punching the work subject material and which generate neither a break in a base material nor bending scratches in bending the work subject material.

The invention claimed is:

1. A surface protection sheet used to protect a metal surface, the surface protection sheet comprising a support base material and an adhesive layer superimposed on one surface of the support base material and also exhibiting a coefficient (I) not more than 21.0 and a coefficient (II) not less than 4.0, both of which are calculated by the following formulae:

(I)=thickness of support base material (mm)×elongation at break of surface protection sheet (%); and (II)=thickness of support base material (mm)×strength at break of surface protection sheet (N/20 mm), wherein the support base material comprises a stretched material obtained by a stretching process such that the elongation at break of the support base material is between 140% to 232%.

2. The surface protection sheet of claim 1, wherein the support base material of the surface protection sheet comprises a polyester film.

3. The surface protection sheet of claim 1, wherein the support base material of the surface protection sheet is biaxially stretched.

4. The surface protection sheet of claim 1, wherein the strength at break of the support base material is from 136 to 370 N/20 mm.

5. The surface protection sheet of claim 1, wherein the adhesive is blended with tackifier within the blending amount range of 0 to 30 parts by weight of tackifier per 100 parts by weight of the adhesive.

6. The surface protection sheet of claim 1, wherein the adhesive layer includes acrylic adhesive.

* * * * *